United States Patent [19]

Effenberger

[11] Patent Number: 4,800,684

[45] Date of Patent: Jan. 31, 1989

[54] APPARATUS FOR GRINDING AND LAPPING SEALING SURFACES IN SLIDE VALVES AND THE LIKE IN SITU OR IN THE WORKSHOP

[76] Inventor: Ranko F. F. Effenberger, Zum Wibbelrusch 6, 5160 Dueren, Fed. Rep. of Germany

[21] Appl. No.: 204,971

[22] Filed: Jun. 3, 1988

Related U.S. Application Data

[62] Division of Ser. No. 863,007, May 14, 1986, abandoned.

[30] Foreign Application Priority Data

May 14, 1985 [DE] Fed. Rep. of Germany ..... 3517409

[51] Int. Cl.[4] ..... B24B 49/02

[52] U.S. Cl. ..... 51/165.76; 51/281 R; 51/241 VS

[58] Field of Search ..... 51/209 R, 119, 120, 51/241 VS, 241 R, 209 R, 241 A, 90, 165.77, 165.76, 281 R, 24 RS

[56] References Cited

U.S. PATENT DOCUMENTS 4,287,112 9/1981 Jensen ..... 51/241 VS
4,287,688 9/1981 Jensen ..... 51/241 VS
4,545,153 10/1985 Miller et al. ..... 51/165.77
4,610,112 9/1986 Kelsey ..... 51/241 VS

*Primary Examiner*—Frederick R. Schmidt
*Assistant Examiner*—Maurina Rachuba
*Attorney, Agent, or Firm*—Staas & Halsey

[57] ABSTRACT

An apparatus for grinding and lapping sealing surfaces in slide valves and the like in situ or in the workshop has a base plate (21), a drive (6), and a rotatably mounted tool plate (3) which is connected to the drive (6) by a supporting element (4) and coupled to it by a transmission element. The supporting element (b 4) is supported releasably and with adjustable height on the base plate (21) by means of a clamping piece (7) of adjustable height and a guide piece (11; 36). The guide piece (11; 36) is mounted pivotably on the base plate (21). Rigidly connected to the guide piece (11; 36) is a rocker (16) which is adjustable relative to the base plate (21) at one end. The strain occurring when such adjustment is made, in the rocker (16), the support (25) of the correcting element (28), the tool plate (3) or the other components which conduct force and/or moment, is assessed as a measure of the contact pressure of the tool plate (3). The strain may be indicated by a digital display (32) or a micrometer dial gauge (39).

2 Claims, 4 Drawing Sheets

FIG.7
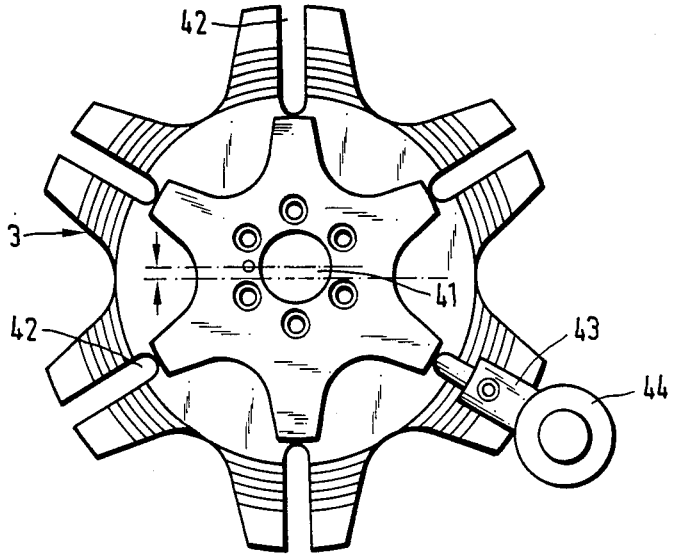
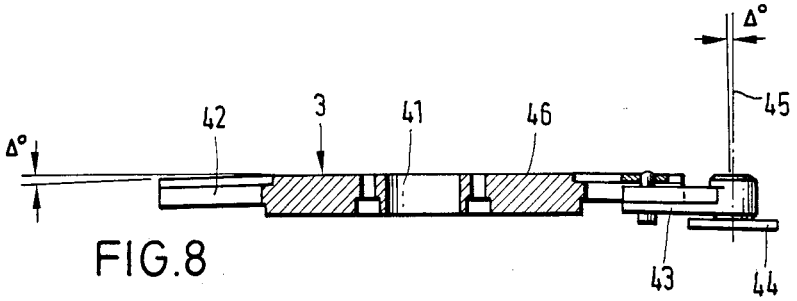
FIG.8
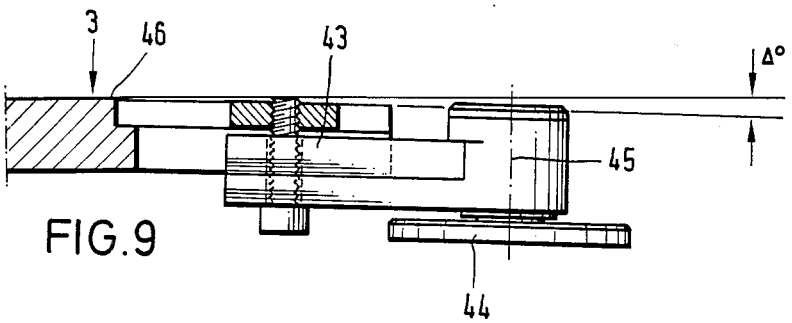
FIG.9

APPARATUS FOR GRINDING AND LAPPING SEALING SURFACES IN SLIDE VALVES AND THE LIKE IN SITU OR IN THE WORKSHOP

This is a divisional of co-pending application Ser. No. 863,007, filed May 14, 1986, now abandoned.

BACKGROUND OF THE INVENTION

The invention concerns an apparatus for grinding and lapping sealing surfaces in slide valves and the like in situ or in the workshop, with a base plate which can be attached to the housing of a slide valve or the like, a drive, and a rotatably mounted tool plate which is connected to the drive by a supporting element and coupled to it by a transmission element, the supporting element being supported releasably and with adjustable height on the base plate by means of a guide piece which is pivotably about a pivot shaft extending perpendicularly to the longitudinal axis of the supporting element and essentially perpendicularly to the axis of the tool plate, wherein rigidly connected to the guide piece is one end of a rocker which extends perpendicularly to the pivot shaft and whose other end is coupled to a correcting element which is supported adjustably on the base plate and allows adjustment of the contact pressure of the tool plate in the direction of the surface to be machined.

Apparatuses of this kind are used in particular to grind and lap sealing surfaces in valves, slide valves, valve discs, valve wedges, valve plates, flanges, pump housings, etc., while they are in the fitted position. In this way, wear phenomena and deposits on these surfaces are eliminated without the workpieces concerned having to be taken out of the respective equipment, and hence without this equipment having to be dismantled.

It has proved extremely difficult, and even impossible with many known apparatuses, to achieve the desired planeness of the surface to be machined with known apparatuses of this kind. This is due to the fact that the pressure acting in an axial direction on the tool plate loads to deformation of this plate, and/or that machining elements mounted on this tool plate, e.g. grinding heads, undergo undesirable tilting according to the contact pressure which arises, on account of elastic deformation and the bearing play which is always present to a greater or lesser degree. If in this case the machining elements are supported on the tool plate by means of arms, attempts have been made, by using feeler gauge strip, to compensate for the inevitably occurring tilt of the working surfaces of the machining elements. But this procedure is very time-consuming, and requires specially qualified skilled workers.

SUMMARY OF THE INVENTION

It is the object of the present invention to avoid the disadvantages of the apparatuses known hitherto, of the kind mentioned hereinbefore, and provide an apparatus of the simplest possible construction with which planeness of the surfaces to be machined can be achieved reliably in a relatively short time.

According to the invention, this object is achieved in an apparatus of the kind mentioned hereinbefore, by the fact that on the tool plate and/or on the support of the correcting element and/or on one of the components conducting force and/or moment between the tool plate and the support of the correcting element, is provided at least one measuring device for measuring strain.

If, in this apparatus, the rocker is pivoted relative to the base plate, then the contact pressure applied to the tool plate is increased or decreased thereby. This displacement of the rocker causes a variation in the load and hence deformation of the components conducting force and moment from the support of the correcting element on the base plate, to the tool plate. This deformation can be regarded as proportional to the contact pressure applied to the tool plate. Consequently, after an initial machining phase, on the measuring device can be read a degree of strain or a degree of stress proportional to the contact pressure. The supporting element with drive and tool plate can thereafter be released from the guide piece in order to check the planeness of the machined surface, e.g. by means of a straight-edge. If it turns out that this surface extends at an angle radially inwards, then after refitting the supporting element with the tool plate, the pressure which is required to correct the present slope of the surface can be set at the rocker. Then a stress or strain can be set which indicates a lower value at the measuring device for a radially inwardly sloping surface, or a higher value for a radially outwardly sloping surface, than at the end of the preceding machining stage.

The measuring device therefore does not indicate the contact pressure which is acting directly on the tool plate, but allows a controlled increase or decrease in this contact pressure, which is necessary to achieve the required planeness, to be produced by simple means.

The apparatus according to the invention may furthermore be constructed in such a way that a measuring device is provided on the rocker.

The apparatus according to the invention may furthermore be constructed in such a way that the measuring device includes at least one wire strain gauge.

The apparatus according to the invention may furthermore be constructed in such a way that the measuring device includes a micrometer dial gauge with a plunger which picks up strain.

The apparatus according to the invention may furthermore be constructed in such a way that the measuring device is connected by a computer to a digital display.

The apparatus according to the invention may furthermore be constructed in such a way that the working surface of the tool plate extends conically, wherein it projects furthest towards a surface to be machined at its radially outer edge. This inclination of the working surface of the tool plate results in an increase in contact pressure deforming the working surface to a plane shape.

The apparatus according to the invention may furthermore be constructed in such a way that the working surface of the tool plate is formed by freely rotatably mounted cylindrical machining elements whose mounting axes converge towards a surface to be machined. In this case, the time-consuming use of feeler gauge strips can be avoided. The consequence of this, then, is faster work and a more reliable result. This tool plate can also be used in combination with an adapter by means of which a lapping wheel or the like can be driven by a drilling machine. In this case, the contact pressure can be determined in a conventional manner from the spring travel or detected by piezoelectric elements and displayed digitally.

Finally, the apparatus according to the invention may be constructed in such a way that the clamping piece is guided in the guide piece and cooperates with a height stop of this guide piece. This provides a simple way in which, after dismounting the supporting element with tool plate and after measuring the machined surface, the tool plate can be returned to the previously adopted machining position rapidly and precisely.

BRIEF DESCRIPTION OF THE DRAWINGS

In the following part of the specification, some embodiments of the apparatus according to the invention are described with reference to drawings.

FIG. 7 shows a plan view of a star-shaped tool plate according to the invention, with grinding heads mounted on arms, FIG. 8 shows an axial section through the tool plate according to FIG. 7, and FIG. 9 shows a partial section of the view according to FIG. 8.

DETAILED DESCRIPTION OF THE PREFERRED EMBODIMENT

Figure 1:
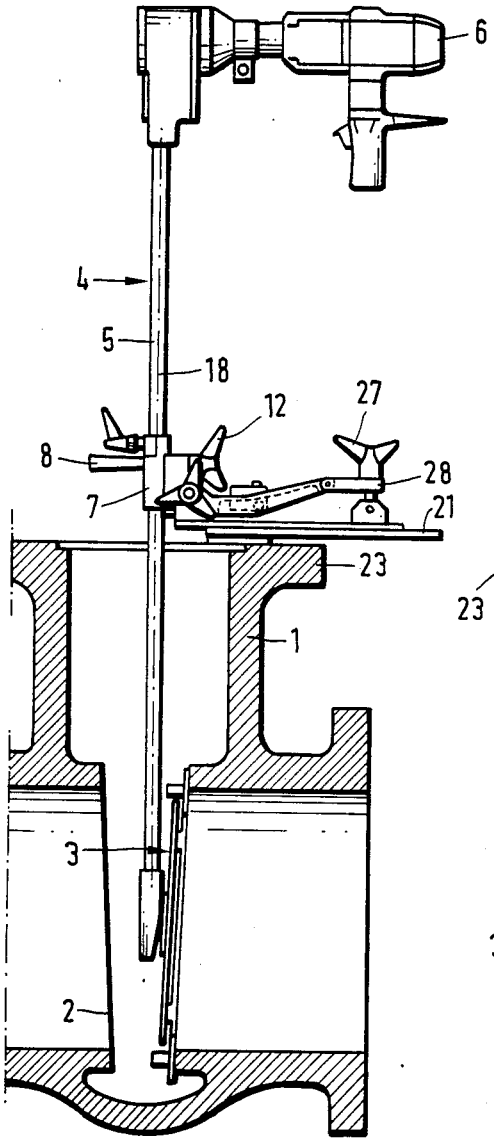
FIG. 1 shows a side view of a first embodiment of the apparatus according to the invention, in conjunction with a slide valve housing.
Figure 2:
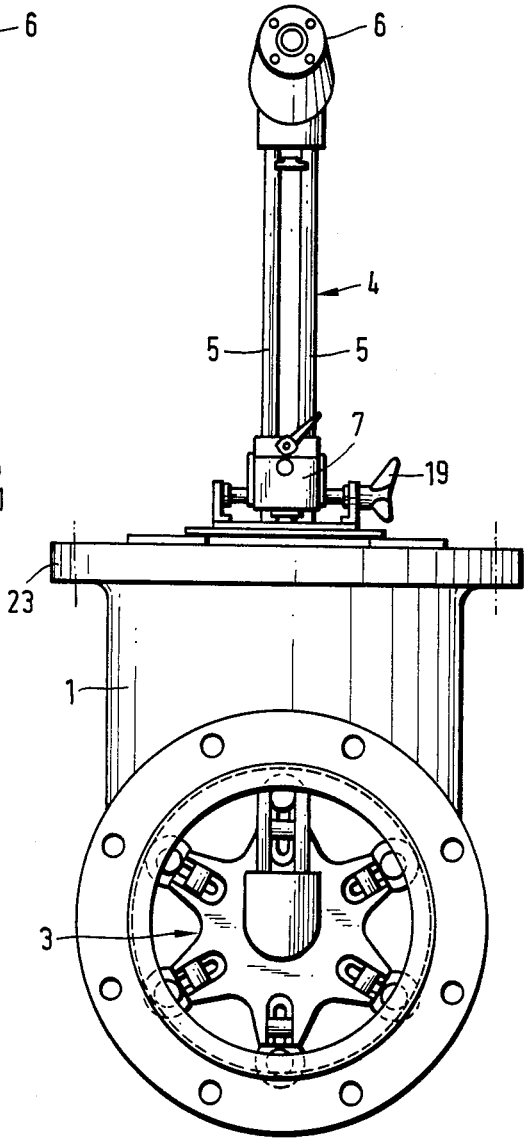
FIG. 2 shows a front view of the embodiment according to FIG. 1.
Figure 3:
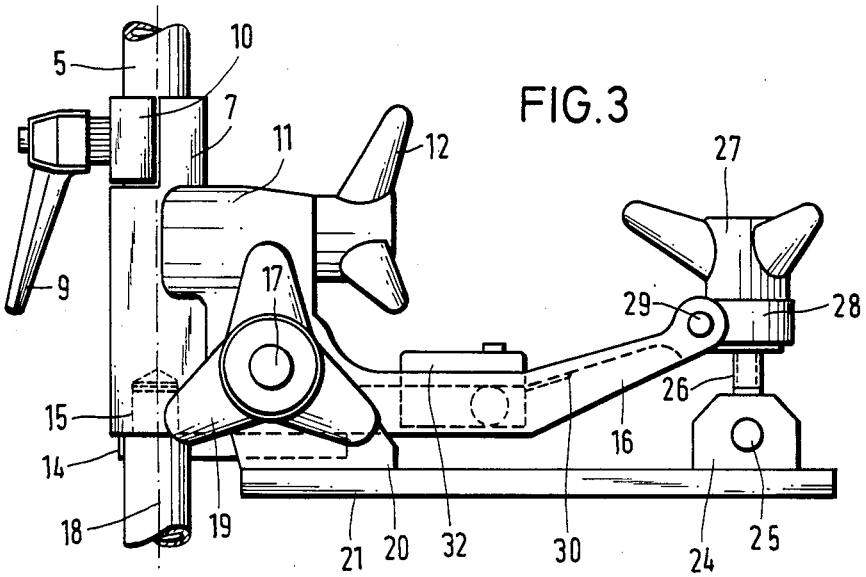
FIG. 3 shows a side view concerning in particular the base plate, the guide piece and the clamping piece.
Figure 4:
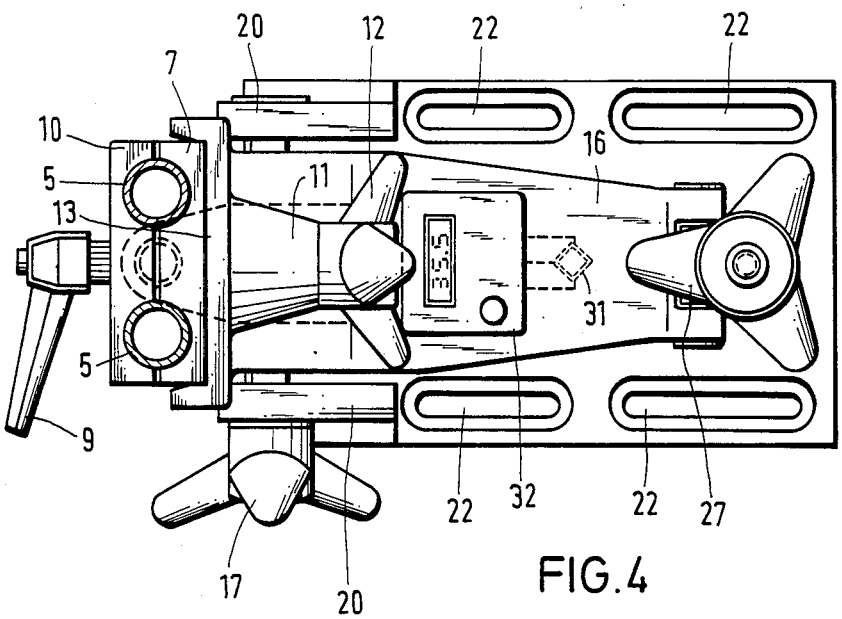
FIG. 4 shows a plan view of the part of the apparatus which is shown in FIG. 3.

FIGS. 1 and 2 show a slide valve housing 1 with an annular annealing surface 2. The sealing surface 2 occurs twice in the housing 1 shown. According to FIGS. 1, 2, a tool plate 3 contacts the sealing surface 2 on the right.

The tool plate 3 is mounted rotatably at the lower end of a supporting element 4 which is formed by two pipes 5. At the upper end of the supporting element 4 is mounted a drive 6 which drives the tool plate 3 via a transmission element (not shown) extending through the pipes 5.

On the pipes 5 is mounted a clamping piece 7 which is provided with a handle 8. By means of a locking screw 9, a clamping element 10 can be forced against the clamping piece 7 in order to fix the latter on the pipes 5 at the desired height. In the embodiment according to FIGS. 1 to 4, the clamping piece 7 is guided in a guide piece 11. By means of a set screw 12, the clamping piece 7 can be fixed in a U-shaped guide 13.

The guide piece 11 comprises in its lower region a height stop 14 which has a pin 15 which engages in the lower end of the clamping piece 7 and thus fixes the clamping piece 7 in the desired position on the guide piece 11.

Integrally connected to the guide piece 11 is a lever-like rocker 16. The component formed from guide piece 11 and rocker 16 is pivotable about a pivot shaft 17 which extends perpendicularly to the longitudinal axis 18 of the supporting element 4. It also extends perpendicularly to the axis of the tool plate 3. The component consisting of guide piece 11 and rocker 16 can be displaced in the direction of the pivot shaft 17 and adjusted, by means of a set screw 19.

The pivot shaft 17 is mounted in two side plates 20 which extend parallel to each other and originate at a base plate 21. This base plate 21 is provided with openings 22 which facilitate connection of the apparatus to a flange 23 of the slide valve housing 1.

On the base plate 21 are further fixed two mounting pieces 24 in which is mounted a transverse pin 25 of a spindle 26. On the spindle 26 is mounted in turn an adjusting knob 27 which carries a correcting element 28. Adjusting knob 27 and correcting element 28 are rotatable relative to each other. But if the adjusting knob 27 is displaced in the direction of the spindle 26, the correcting element 28 is entrained with it. The latter is connected by a transverse shaft 29 to the end of the rocker 16 which is remotest from the guide piece 11. Turning the adjusting knob 27 thus results in pivoting of the guide piece 11, and hence an increase or decrease in contact pressure which acts on the tool plate 3. This variation in pressure results in deformation of the rocker 16. In the embodiment according to FIGS. 1 to 3, this deformation is detected by wire strain gauges 30 and a suitable computer circuit 31 and displayed digitally in the display unit 32.

Figure 5:
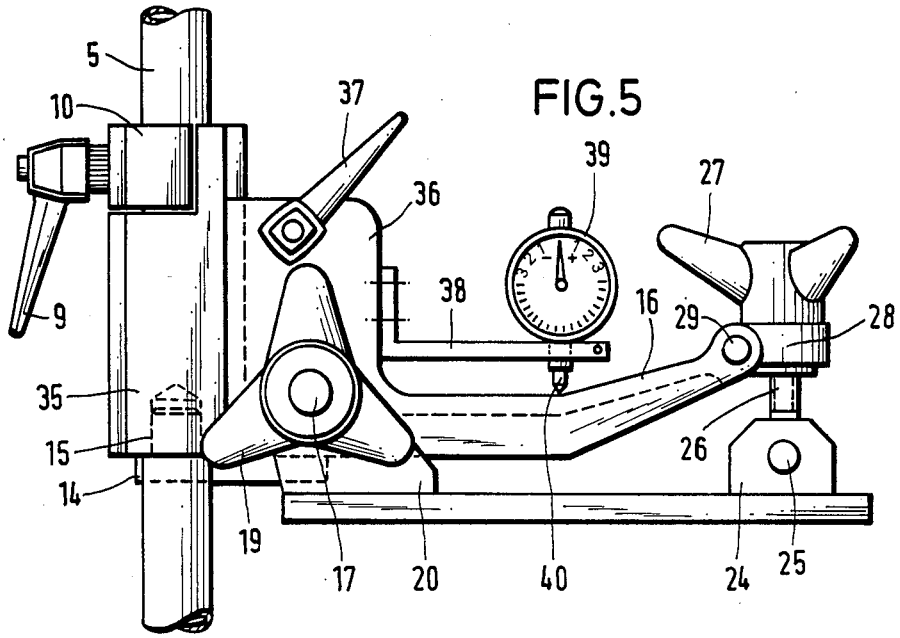
FIG. 5 shows a partial view similar to FIG. 3, in which a micrometer dial gauge is used as the measuring device.
Figure 6:
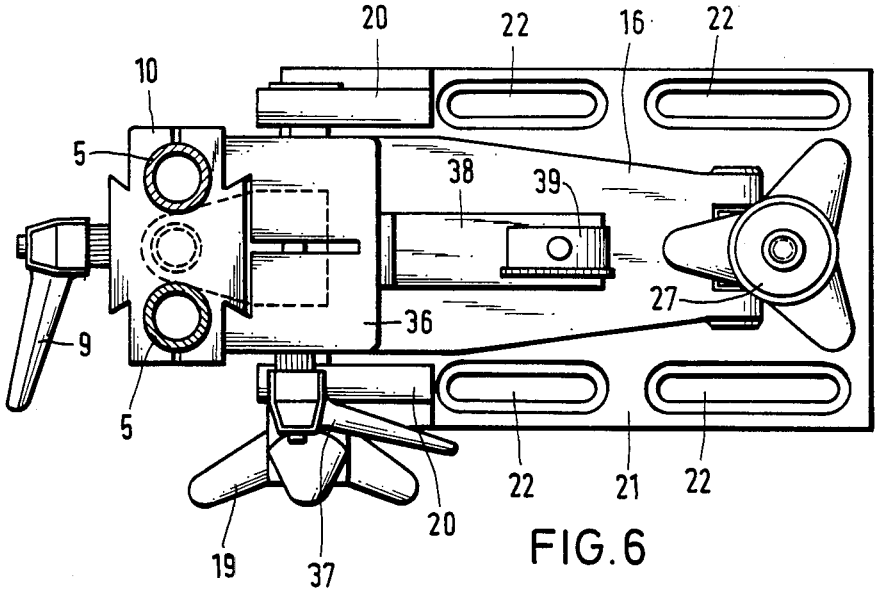
FIG. 6 shows a plan view of the part of the apparatus which is shown in FIG. 5.

The embodiment according to FIGS. 5 and 6 differs from the embodiment described above only in the characteristics described below. In this embodiment is provided a clamping piece 35 which engages in and is guided in a guide piece 36. The two components are guided over each other in dovetail fashion. A locking screw 37 fixes the clamping piece 35 in the desired position on the guide piece 36. In this embodiment too are provided a base plate 21 and a rocker 16 which is integrally connected to the guide piece 36 and which can be adjusted by a correcting element 28. Unlike the embodiment according to FIGS. 1 to 4, a holder 38 which carries a micrometer dial gauge 39 is rigidly connected to the guide piece 36. This micrometer dial gauge 39 has a plunger 40 which touches the rocker 16 and registers strain in this rocker 16 which is essentially proportional to the stress on the rocker 16 and hence the contact pressure of the tool plate 3.

In FIGS. 7 to 9, the tool plate 3 according to the invention is described in detail. It has an eccentric bore 41 and is star-shaped. It comprises six radially extending guide slots 42 which are evenly distributed over the circumference and in each of which an arm 43 can be displaced and then locked in the desired position. Each arm 43 carries at its radially outer end a grinding head 44 which is freely rotatable about a shaft 45. This shaft 45 runs in ball bearings. As shown in particular by FIGS. 8 and 9, the tool plate 3 in the region of the guide slots 42 slopes at an angle towards the grinding heads 44. The angle of inclination of the slots relative to the surface 46 of the tool plate 3 corresponds to the angle V. The shafts 45 of the grinding heads 44 are inclined at the same angle relative to the axis of the tool plate 3.

If there is now applied to the tool plate 3 a contact pressure which, in FIGS. 8 and 9, acts from top to bottom, then the given tilts are reduced. To what extent such a reduction takes place, or whether even a reverse tilt in an upward direction is set, depends on the respective contact pressure. With all the embodiments of the apparatus described, both the sealing surface shown on the right in FIG. 1 and the sealing surface shown on the left there, can be machined.

After an initial machining stage, the drive 6 is switched off. The value indicated at the measuring device 32, 39 is recorded. Then the tool plate 3 with supporting element 4 and drive 6 is dismounted. The machined surface is now checked with a straight-edge. It is established whether the work is to be carried out with a higher or lower contact pressure in the next machining stage to achieve planeness. The tool plate 3 with the associated components is refitted. The value previously detected at the measuring device 32, 39 is then increased or decreased according to the required pressure variation.

I claim:

1. A method for grinding and lapping sealing surfaces in slide valves and the like, said method comprising:

releasably positioning a rotatable tool plate adjacent a said surface to be ground and lapped for rotation about an axis which is generally perpendicular to said surface;

urging said tool plate against said surface in a direction generally parallel to said axis while rotating said plate to thereby grind said surface;

measuring the resistance to movement of said plate toward the surface during said grinding;

checking the planeness of the ground surface; and thereafter repositioning the plate and adjusting the force urging the tool plate against said surface as required using the measured resistance as a guide to thereby condition the plate for grinding said surface to the desired planeness.

2. A method as set forth in claim 1, wherein said measuring step is performed using a strain gauge.

* * * * *